US005146859A

United States Patent [19]

Conley, Jr. et al.

[11] Patent Number: 5,146,859

[45] Date of Patent: Sep. 15, 1992

[54] ADJUSTABLE CLAMP FOR USE IN A SEWING MACHINE

[75] Inventors: Ralph F. Conley, Jr., Miamisburg; Clint E. Gehres, Moraine, both of Ohio

[73] Assignee: MIM Industries, Inc., Miamisburg, Ohio

[21] Appl. No.: 718,012

[22] Filed: Jun. 20, 1991

[51] Int. Cl.[5] ..... D05B 3/20

[52] U.S. Cl. ..... 112/114; 112/265.1; 112/262.3; 112/121.12

[58] Field of Search ..... 112/103, 104, 114, 119, 112/121.12, 121.15, 262.1, 262.3, 320, 265.1

[56] References Cited

U.S. PATENT DOCUMENTS

| | | | |
|---|---|---|---|
| 164,241 | 6/1875 | Wheeler . | |
| 278,485 | 5/1883 | Arnold . | |
| 1,222,618 | 4/1917 | Gammons . | |
| 1,387,034 | 8/1921 | Fifield | 112/114 |
| 1,569,231 | 1/1926 | Mayo | 112/121.15 X |
| 2,223,626 | 12/1940 | Ladue | 112/2 |
| 2,630,087 | 3/1953 | Liero et al. | 112/114 X |
| 2,726,613 | 12/1955 | Eddy | 112/114 |
| 3,104,637 | 9/1963 | Hedegaard | 112/104 |
| 3,664,283 | 5/1972 | McFalls | 112/121.15 |
| 3,664,288 | 5/1972 | Von Boden et al. | 112/103 |
| 3,739,733 | 6/1973 | Schramayr | 112/121.12 |
| 3,799,086 | 3/1974 | Block | 112/121.15 |
| 3,830,175 | 8/1974 | Levor | 112/121.12 |
| 3,875,877 | 4/1975 | Fox | 112/63 |
| 3,875,878 | 4/1975 | Kaminski | 112/116 |
| 3,970,016 | 7/1976 | Yanikoski | 112/121.12 |
| 4,171,672 | 10/1979 | Dorosz et al. | 112/121.12 |
| 4,273,059 | 6/1981 | Kamal | 112/121.14 |
| 4,296,699 | 10/1981 | Vartoukian | 112/121.15 |
| 4,305,338 | 12/1981 | Adamson | 112/113 |
| 4,455,952 | 6/1984 | Monn et al. | 112/121.12 |
| 4,462,320 | 7/1984 | Scholl | 112/104 |
| 4,479,447 | 10/1984 | Rohr | 112/141 |
| 4,493,276 | 1/1985 | Sadeh | 112/121.12 |
| 4,498,407 | 2/1985 | Landwehr et al. | 112/308 |
| 4,503,788 | 3/1985 | Giannuzzi et al. | 112/121.12 |
| 4,534,303 | 8/1985 | Off et al. | 112/114 |
| 4,603,647 | 8/1986 | Conley, Jr. et al. | 112/129 |
| 4,610,210 | 9/1986 | Kinoshita et al. | 112/121.12 |
| 4,622,907 | 11/1986 | Kimura | 112/121.12 |
| 4,639,964 | 2/1987 | Binder | 12/142 |
| 4,664,045 | 5/1987 | Landwehr et al. | 112/153 |
| 4,682,551 | 7/1987 | Toman | 112/103 |
| 4,696,242 | 9/1987 | Scholl et al. | 112/121.14 |
| 4,708,072 | 11/1987 | Frye | 112/121.27 |
| 4,763,587 | 8/1988 | Frye | 112/121.12 |
| 4,799,438 | 1/1989 | Hinckle | 112/121.12 |
| 4,854,251 | 8/1989 | Hiramatsu et al. | 112/121.12 |
| 4,870,917 | 10/1989 | Frye | 112/121.12 |
| 4,883,006 | 11/1989 | Marii et al. | 112/121.12 |
| 4,920,904 | 5/1990 | Frye | 112/262.1 |
| 4,989,525 | 2/1991 | Portilla | 112/10 |
| 5,005,501 | 4/1991 | Kita | 112/121.12 |
| 5,014,663 | 5/1991 | Murata et al. | 112/121.12 |

OTHER PUBLICATIONS

"The Technologies of MIM Industries, Inc." Sales Brochure, published approximately Jan. 1, 1990.

*Primary Examiner*—Werner H. Schroeder
*Assistant Examiner*—Paul C. Lewis

[57] ABSTRACT

An adjustable clamp for use in a sewing machine. The adjustable clamp has a plurality of adjustable clamp members which are slidably and adjustably fastened to a support, thereby enabling the adjustable clamp to be adjusted to a predetermined clamp size or pattern so that the adjustable clamp can clamp workpieces of different shapes against a clamping surface of the sewing machine.

22 Claims, 2 Drawing Sheets

FIG. 1
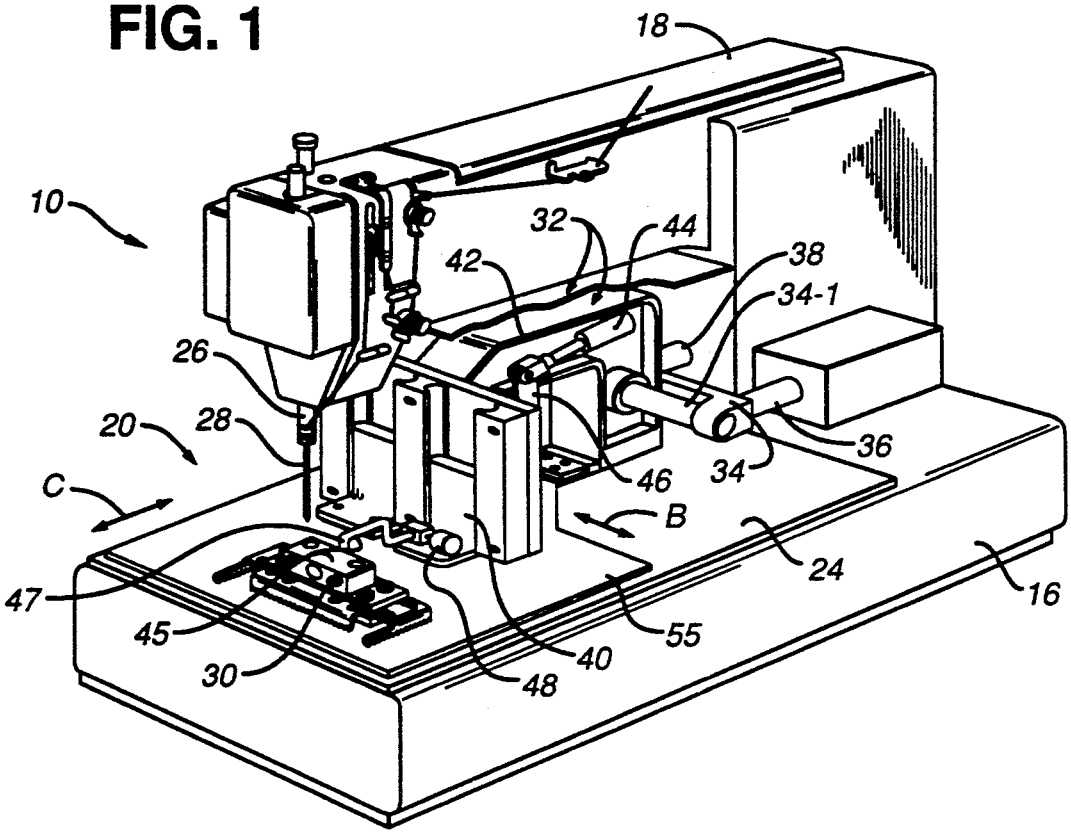
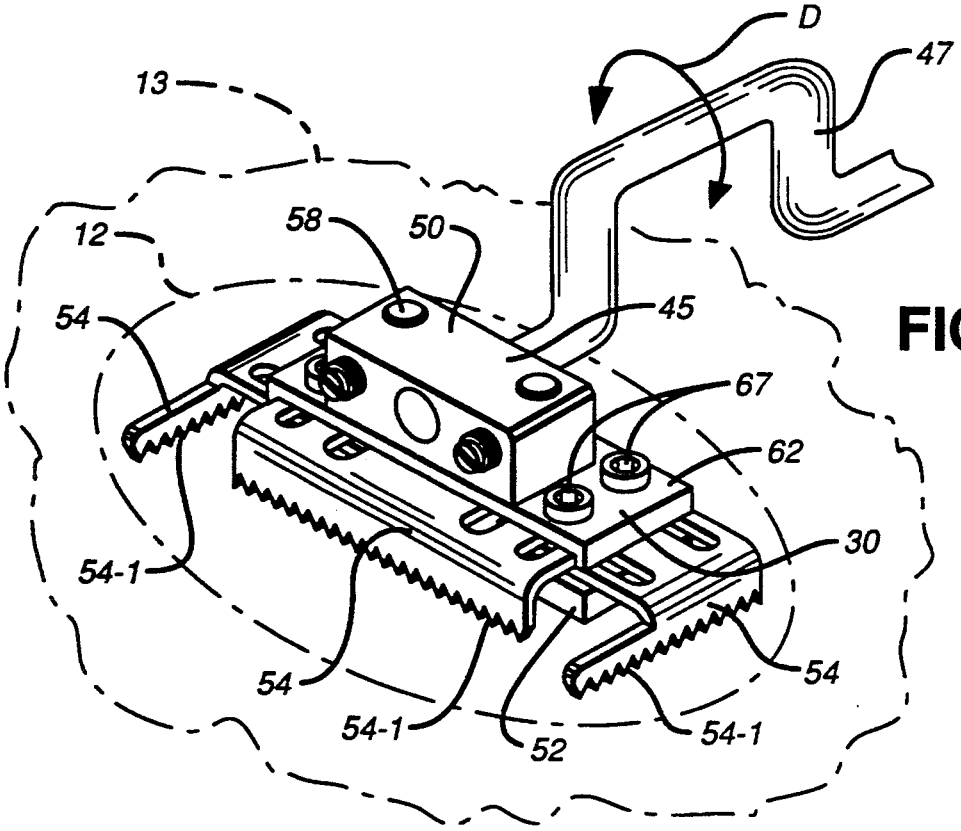
FIG. 2

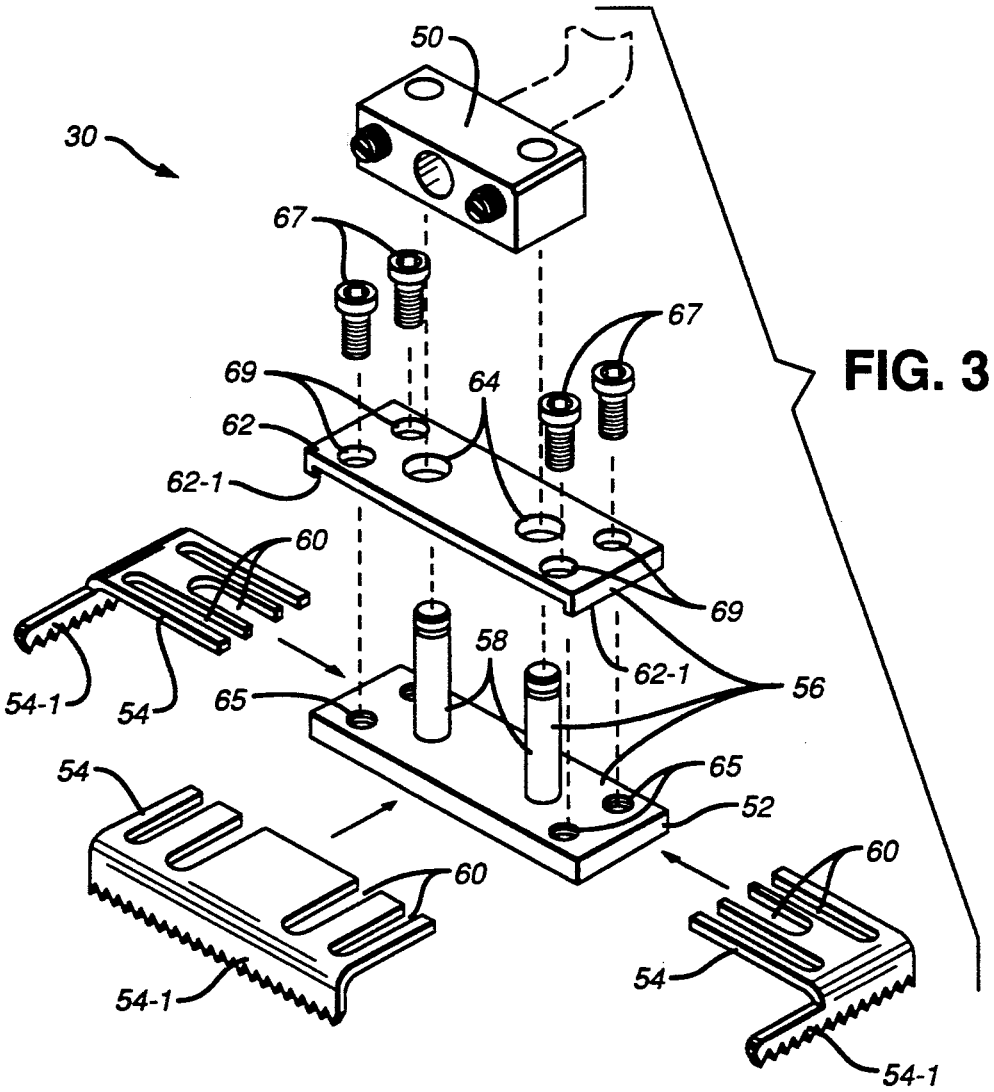
FIG. 3
FIG. 4
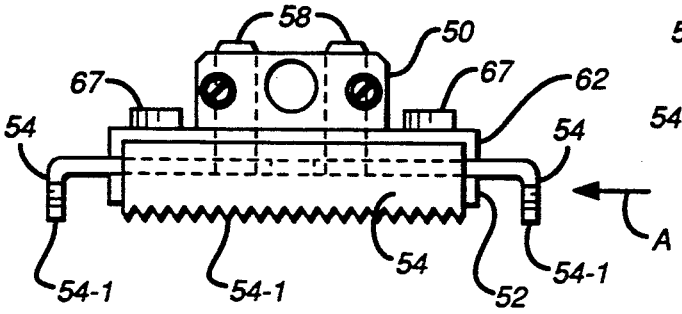
FIG. 5
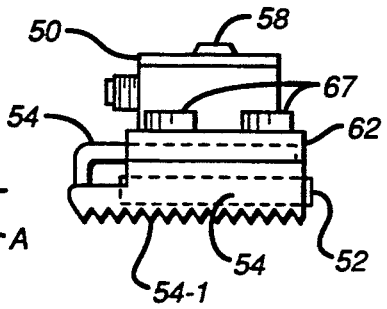

ADJUSTABLE CLAMP FOR USE IN A SEWING MACHINE

BACKGROUND OF THE INVENTION

1. Field of the Invention

This invention relates to a clamp, and more particularly, it relates to an adjustable clamp having a plurality of adjustable clamp members which can be adjusted to a predetermined clamp size, thereby enabling the adjustable clamp to clamp sewing workpieces of different shapes against a clamping surface in a programmable sewing machine.

2. Description of Related Art.

In the sewing industry, a common repetitive function is to sew a label onto a workpiece of material. For example, this would be a common procedure when sewing a manufacturer's label onto a workpiece, such as a shirt or jacket. A clamp was typically used to force the central portion of the label against the workpiece and also against the sewing surface of the sewing machine. The sewing machine then moved the workpiece and label under an oscillating needle in order to sew the label onto the workpiece with a predetermined stitch pattern. The clamp was also used to secure either the label or the workpiece against the sewing surface so that the predetermined stitch pattern could be sewn thereon. The clamps of the prior art had a defined clamping surface which could not be adjusted to accommodate labels of different shapes or to accommodate different predetermined stitch patterns. Accordingly, a user was required to maintain an inventory of clamps for each workpiece shape and for each predetermined stitch pattern. Maintaining such an inventory of clamps was expensive.

Still another problem is that the programmable sewing machine had to be shut down whenever the adjustable clamp had to be changed due to a change in either the predetermined stitch pattern or the workpiece shape. This downtime resulted in lost production and labor time.

SUMMARY OF THE INVENTION

There is, therefore, a present need to provide an adjustable clamp having a plurality of adjustable clamp members which permit the clamp to be adjustable to a predetermined clamp size.

In one aspect, this invention includes an adjustable clamp for securing a workpiece having a predetermined shape against a clamping surface at a sewing station in a sewing machine, said adjustable clamp comprising a support; a plurality of clamp members; adjusting means for adjustably securing said at least one of said plurality of clamp members to said support; and means for permitting the sewing machine to sew around the support and said plurality of clamp members, said means comprising a connector coupled to said support for detachably mounting said support to said sewing machine; said at least one of said plurality of clamp members being adjustably secured to said support so that said plurality of clamp members will define a predetermined clamp size which generally corresponds to the predetermined shape, thereby permitting the adjustable clamp to clamp workpieces of different shapes against the clamping surface when the support is mounted to the sewing machine.

In another aspect, this invention includes a method for sewing a workpiece that is clamped against a sewing surface of a sewing machine, said method comprising the steps of: (a) positioning an adjustable clamp in operative relationship with said sewing surface; said adjustable clamp having a support and at least one adjustable pressure member adjustably fastened to the support; (b) adjusting said at least one adjustable pressure member so that said adjustable clamp has a predetermined clamp size which generally corresponds to the shape of the workpiece; (c) causing said at least one adjustable pressure member to force the workpiece against the sewing surface, thereby clamping the workpiece against the sewing surface in the sewing machine; and (d) sewing a predetermined stitch pattern on the workpiece by sewing around said support and said at least one adjustable pressure member of the adjustable clamp.

An object of this invention is to provide an adjustable clamp which can be adjusted in order to clamp labels of different shapes against a workpiece.

Another object of this invention is to provide an adjustable clamp which can be adjusted in order to accommodate a change in a predetermined stitch pattern being sewn on a label or workpiece.

Another object of this invention is to provide an adjustable clamp which eliminates the need for maintaining an inventory of clamps of different shapes.

Still another object of this invention is to provide a adjustable clamp which can be easily adjusted to provide a predetermined clamping area.

Yet another object of this invention is to provide a method which permits an operator to quickly and easily adjust the clamping area of an adjustable clamp in order to accommodate labels having different shapes.

These objects, and others, may be more readily understood in connection with the following specification, claims, and drawing.

BRIEF DESCRIPTION OF THE DRAWING

FIG. 1 is a perspective view of a programmable sewing machine in which a preferred embodiment of this invention may be used;

FIG. 2 is a perspective view of an adjustable clamp coupled to a crank by mounting means;

FIG. 3 is a perspective exploded view of the adjustable clamp shown in FIG. 2;

FIG. 4 is an assembled front of the adjustable clamp; and

FIG. 5 is an assembled side view of the adjustable clamp, taken in the direction of arrow A in FIG. 4.

DESCRIPTION OF THE PREFERRED EMBODIMENT

FIG. 1 shows a perspective view of a programmable sewing machine, hereinafter designated as sewing machine 10, in which a preferred embodiment of this invention may be used. The function of the sewing machine 10 is to sew a workpiece 12 (shown in phantom in FIG. 2), such as a label or shirt pocket, onto a second workpiece 13, like a jacket or shirt. In a preferred embodiment, the workpiece 12 is sewn onto the second workpiece 13 with a predetermined stitch pattern (not shown) in accordance with a computer program (not shown) which is controlled by a master controller (not shown) in the sewing machine 10. The sewing machine 10 may be any programmable sewing machine, including any of the Brother BAS Series 300 programmable sewing machines, such as the BAS Model 340, which are manufactured by Brother Industries of Japan. The sewing machine 10 comprises a base 16 having a horizontal arm 18 secured thereto. The sewing machine 10 also comprises a sewing station 20 at which the workpiece 12 can be sewn onto the second workpiece 13 with the predetermined stitch pattern. The sewing station 20 (FIG. 1) includes a sewing surface 24. As best illustrated in FIG. 1, the horizontal arm 18 extends out over the sewing surface 24, and it has a needle holder 26 near the end thereof. The needle holder 26 supports a needle 28 for reciprocating motion in a fixed path that is generally vertical and perpendicular to the sewing surface 24. The needle 28 moves down through a hole (not shown) in a throat plate (not shown) at the bottom of its stroke to transfer a loop of thread (not shown) to a looptaker (not shown) under the sewing surface 24 at the sewing station 20. The looptaker and needle 28 are both connected to a motor (not shown) which is controlled by the master controller (not shown) in the sewing machine 10.

The sewing machine 10 further includes an adjustable clamp 30 which is coupled to drive means 32. The function of drive means 32 is to move the adjustable clamp 30 at the sewing station 20 in accordance with the computer program (not shown) so that the workpiece 12 can be sewn on the second workpiece 13. The drive means 32 comprises a yoke shaft 34-1 of a yoke 34 which permits the adjustable clamp 30 to move in an X direction, indicated by double arrow B in FIG. 1. The yoke 34 is coupled to a pair of shafts 36 and 38 which can cause the yoke 34 and adjustable clamp 30 to move in a Y direction, indicated by double arrow C in FIG. 1. The shafts 36 and 38 are coupled to a stepper motor (not shown) by various belts, gears and pulleys (not shown) in the sewing machine 10. As best illustrated in FIG. 1, the adjustable clamp 30 is coupled to an L-shaped bracket 40 which is slidably mounted to a support arm 42. The drive means 32 also comprises a solenoid 44 which is coupled to L-shaped bracket 40 by armature 46. The support arm 42 is coupled to a second stepper motor (not shown) under sewing surface 24. Although not shown, the drive means 32 could include a different configuration of drive mechanisms, such as solenoids (not shown), gears (not shown) and pulleys (not shown), or it could include any other suitable means for moving the adjustable clamp 30 in the X or Y directions. The master controller (not shown) can energize the stepper motor and the second stepper motor individually or simultaneously to move the adjustable clamp 30 in the X or Y directions, thereby permitting the sewing machine 10 to move the adjustable clamp 30 in accordance with the computer program so that the workpiece 12 can be sewn on the second workpiece 13 with the predetermined stitch pattern. In addition, the master controller can also energize the solenoid 44 to cause the L-shaped bracket 40 and the adjustable clamp 30 to move towards and away from the sewing surface 24.

The sewing machine 10 also comprises means for permitting the sewing machine 10 to sew around the support 52 and clamp members 54. The means may comprise any suitable means for permitting the sewing machine to sew around the support 52, but in the embodiment being described, means comprises mounting means 45 (FIG. 1) for detachably mounting the adjustable clamp 30 to the L-shaped bracket 40. The mounting means 45 comprises a 360 degree crank 47 which is coupled to a solenoid 48 which in turn is coupled to the master controller (not shown). The master controller can selectively energize the solenoid 48 to cause the crank 46 to flip-flop in the direction of double arrow D in FIG. 2 so that the sewing machine can sew a 360 stitch pattern. The mounting means 45 further comprises a quick-release mechanism 50 which enables the adjustable clamp 30 to be quickly and easily dismounted from the sewing machine 10. The quick release mechanism 50 is similar to the release mechanisms shown and described in U.S. Pat. No. 4,763,587, issued on Aug. 16, 1988, and U.S. Pat. No. 4,870,917, issued on Oct. 3, 1989, which are assigned to the same assignee as the present application and which are hereby incorporated by reference and made a part hereof. Although not shown, the mounting means 45 could include a different means for mounting the adjustable clamp 30 to the sewing machine 10, such as machine screws, bolts, welding or any other suitable means for securing the adjustable clamp 30 to the sewing machine 10.

As best shown in FIGS. 2-5, the sewing machine 10 comprises the adjustable clamp 30 which forces the workpiece 12 against the second workpiece 13 until the workpiece 12 and second workpiece 13 are secured firmly against a cloth plate 55 (FIG. 1). The adjustable clamp 30 comprises the support 52 which is generally planar as best shown in FIG. 3. The adjustable clamp 30 also comprises a plurality of clamp members 54 which are each generally L-shaped, as best shown in FIG. 3. Each of the clamp members 54 has a saw-toothed edge 54-1 which define a predetermined clamping size or pattern. The saw-toothed edges 54-1 facilitate preventing the workpiece 12 and second workpiece 13 from slipping or moving when they are being secured against the cloth plate 55.

The adjustable clamp 30 also includes adjusting means for adjustably securing at least one of said plurality of clamp members 54 to the support 52. In the embodiment being described, adjusting means comprises a fastener 56 for adjustably fastening the plurality of clamp members 54 to the support 52. In a preferred embodiment the fastener 56 includes a pair of posts 58 which upstand from the support 52, as shown in FIG. 3. The fastener 56 also includes a cooperating member 62 having a plurality of apertures 64 for receiving the posts 58. The cooperating member 62 has a depending flange 62-1 on each end thereof which engage the clamp members 54. The cooperating member 62 also comprises apertures 69 for receiving a plurality of screws 67, such as conventional machine screws. The screws 67 are threaded in the threaded holes 65 to secure the cooperating member 62 to the support 52 as shown. Although an embodiment of the adjusting means and fastener 56 has been shown and described herein, it should be appreciated that adjusting means and the fastener 56 could comprise any suitable means for adjustably securing at least one of said plurality of clamp members 54 to the support 52.

As best illustrated in FIGS. 4 and 5, the cooperating member 62 cooperates with the support 52 to secure the plurality of clamp members 54 between the cooperating member 62 and the support 52. Each of the clamp members 54 have slots or grooves 60 which permit the clamp members 54 to be slidably adjusted on the support 52. This feature enables the clamp members 54 to be adjusted so that the adjustable clamp 30 has many different predetermined clamping sizes or patterns. The clamp members 54 can be adjusted in order to provide a larger or smaller clamping pattern if desired. Although the embodiment herein has been shown with a clamping pattern which is generally rectangular, the clamp members 54 could be changed to, for example, clamp members 54 having a circular saw-toothed edge 54-1 which would facilitate providing a circular clamping pattern if desired.

In operation, the apertures 64 (FIG. 3) on the cooperating member 62 are guided onto the posts 58 of the support 52, and the screws 67 are used to secure the cooperating member 62 to the support 52. The grooves 60 of the clamp members 54 are then guided onto the posts 58 and screws 67. The clamp members 54 are adjusted to the predetermined clamp size or pattern which generally corresponds to the shape of the workpiece 12. After the clamp members 54 have been adjusted to a predetermined clamp size, the screws 67 can then be tightened until the clamp members 54 become secured between the support 52 and the cooperating member 62. The adjustable clamp 30 can then be detachably mounted onto the sewing machine 10 by inserting the posts 58 into the quick-release mechanism 50 (FIG. 1) mentioned earlier herein. Although not shown, the clamp members 54 of the adjustable clamp 30 could be adjusted while the support 52 and cooperating member 62 are mounted to the sewing machine 10. This can be done by loosening the screws 67, adjusting the clamp members 54, and then tightening the screws 67, thereby providing a new predetermined clamp size or pattern.

After the adjustable clamp 30 has been adjusted to the appropriate predetermined clamp size and mounted to the sewing machine 10, the second workpiece 13 can be positioned on the cloth plate 55. The workpiece 12 can then be positioned on the second workpiece 13. The master controller (not shown) can then energize drive means 32 to cause the adjustable clamp 30 to clamp the workpiece 12 against the second workpiece 13 so that the workpiece 12 can be sewn onto the second workpiece 13 with the predetermined stitch pattern. In addition, the adjustable clamp 30 could be used to secure either the workpiece 12 or the second workpiece 13 against the cloth plate 55 so that the sewing machine 10 can sew the predetermined stitch pattern thereon. This may be beneficial, for example, when sewing an ornamental pattern (not shown) on a label (not shown).

Various changes or modifications in the invention described may occur to those skilled in the art without departing from the spirit or scope of the invention. The above description of the invention is intended to be illustrative and not limiting, and it is not intended that the invention be restricted thereto but that it be limited only by the true spirit and scope of the appended claims.

What is claimed is:

1. An adjustable clamp for securing a workpiece having a predetermined shape against a clamping surface at a sewing station in a sewing machine, said adjustable clamp comprising:

a support;

a plurality of clamp members;

adjusting means for adjustably securing said at least one of said plurality of clamp members to said support; and means for permitting the sewing machine to sew around the support and said plurality of clamp members, said means comprising a connector coupled to said support for detachably mounting said support to said sewing machine;

said at least one of said plurality of clamp members being adjustably secured to said support so that said plurality of clamp members will define a predetermined clamp size which generally corresponds to the predetermined shape, thereby permitting the adjustable clamp to clamp workpieces of different shapes against the clamping surface when the support is mounted to the sewing machine.

2. The adjustable clamp as recited in claim 1 wherein said adjusting means comprises a fastener for adjustably fastening said at least one of said plurality of said clamp members to said support.

3. The adjustable clamp as recited in claim 1 wherein said connector comprises a quick-release mechanism.

4. The adjustable clamp as recited in claim 2 wherein said fastener has at least one post upstanding from said support, said at least one of said plurality of clamp members having at least one groove therein which permit said fastener to adjustably secure said at least one of said plurality of clamp members to said support.

5. The adjustable clamp as recited in claim 1 wherein each of said plurality of clamp members had a saw-toothed edge which is capable of forcing the workpiece into engagement with the clamping surface.

6. The adjustable clamp as recited in claim 4 wherein each of said plurality of clamp members has a saw-toothed edge which is capable of forcing the workpiece into engagement with the clamping surface.

7. The adjustable clamp as recited in claim 4 wherein said support is generally rectangular and said fastener further comprises a cooperating member, said cooperating member having a plurality of apertures therein for receiving said at least one post member and for cooperating with said support to secure each of said plurality of clamp members between said cooperating member and said support.

8. The adjustable clamp as recited in claim 1 wherein each of said plurality of clamp members is generally L-shaped.

9. A clamp for forcing a workpiece against a clamping surface in a sewing machine; said clamp comprising:

a support;

a plurality of clamp members associated with said support;

at least one of said plurality of clamp members being adjustable so as to provide an adjustable clamp member;

a fastener for adjustably fastening said at least one of said plurality of said clamp members to said support;

means for permitting the sewing machine to sew around the support and said plurality of clamp members, said means comprising connection means for detachably mounting said support to the sewing machine;

said fastener adjustably fastening said adjustable clamp member to said support in a predetermined clamp size in order to clamp workpieces of different shapes against the clamping surface when the support is mounted to said sewing machine.

10. The clamp as recited in claim 9 wherein said fastener comprises at least one post upstanding from said support, said at least one clamp member having at least one groove therein which permit said adjustable clamp member to be slidably adjusted on said support.

11. The clamp as recited in claim 9 wherein each of said plurality of clamp members are generally L-shaped and comprise a saw-toothed edge which forces the workpiece into engagement with the clamping surface.

12. The clamp as recited in claim 11 wherein said support comprises a plurality of post members upstanding therefrom said support comprising a shape and said fastener further comprising a cooperating member which generally corresponds to the shape of the support, said cooperating member having a plurality of apertures therein for receiving said plurality of post members and for cooperating with said support to secure each of said plurality of clamp members against said support.

13. The clamp as recited in claim 9 wherein said connection means comprises a quick-release mechanism coupled to said support and a 360° crank for coupling said quick-release mechanism to said sewing machine.

14. The clamp as recited in claim 13 wherein said 360 degree crank comprises a generally U-shaped shaft.

15. A sewing machine for sewing a predetermined stitch pattern on a workpiece, said sewing machine comprising:

a controller for controlling the operation of the sewing machine;

an adjustable clamp for forcing a workpiece having a predetermined shape against a clamping surface in the sewing machine; said adjustable clamp comprising adjusting means for enabling said adjustable clamp to be adjustable in order to accommodate workpieces of different shapes;

means for permitting said sewing machine to sew completely around said adjustable clamp so that the sewing machine can sew a 360 degree sewing pattern on said workpiece, said means comprising connection means for mounting said adjustable clamp to said sewing machine; and drive means coupled to said controller and said connection means for driving the clamp into engagement with the workpiece to secure the workpiece against the clamping surface, said drive means also being capable of moving said clamping surface in accordance with a program stored in said sewing machine in order to sew the predetermined stitch pattern on the workpiece;

said adjustable clamp being adjustable to permit the sewing machine to clamp workpieces of different shapes against the clamping surface so that the predetermined stitch pattern can be sewn on the workpiece when said controller causes said drive means to move the clamping surface in accordance with said program.

16. A sewing machine for sewing a predetermined stitch pattern on a workpiece, said sewing machine comprising:

a controller for controlling the operation of the sewing machine;

an adjustable clamp for forcing a workpiece having a predetermined shape against a clamping surface in the sewing machine; said adjustable clamp comprising adjusting means for enabling said adjustable clamp to be adjustable in order to accommodate workpieces of different shapes;

means for permitting said sewing machine to sew completely around said adjustable clamp so that the sewing machine can sew a 360 degree sewing pattern on said workpiece, said means comprising connection means for mounting said adjustable clamp to said sewing machine; and drive means coupled to said controller and said connection means for driving the clamp into engagement with the workpiece to secure the workpiece against the clamping surface, said drive means also being capable of moving said clamping surface in accordance with a program stored in said sewing machine in order to sew the predetermined stitch pattern on the workpiece;

said adjustable clamp being adjustable to permit the sewing machine to clamp workpieces of different shapes against the clamping surface so that the predetermined stitch pattern can be sewn on the workpiece when said controller causes said drive means to move the clamping surface in accordance with said program;

said adjustable clamp comprising:

a support; and a plurality of clamp members;

said adjusting means comprising a fastener for adjustably fastening said plurality of clamp members to said support;

said plurality of clamp members being adjustable to provide a clamp having a predetermined clamp size which generally corresponds to the shape of the workpiece.

17. The sewing machine as recited in claim 16 wherein said fastener comprises at least one post upstanding from said support, each of said plurality of clamp members having at least one groove therein which permit each of said plurality of clamp members to be slidably adjusted on said support.

18. The sewing machine as recited in claim 17 wherein each of said plurality of clamp members is generally L-shaped and comprises a saw-toothed edge which forces the workpiece into engagement with the clamping surface.

19. A sewing machine for sewing a predetermined stitch pattern on a workpiece, said sewing machine comprising:

a controller for controlling the operation of the sewing machine;

an adjustable clamp for forcing a workpiece having a predetermined shape against a clamping surface in the sewing machine; said adjustable clamp comprising adjusting means for enabling said adjustable clamp to be adjustable in order to accommodate workpieces of different shapes;

means for permitting said sewing machine to sew completely around said adjustable clamp so that the sewing machine can sew a 360 degree sewing pattern on said workpiece, said means comprising connection means for mounting said adjustable clamp to said sewing machine; and drive means coupled to said controller and said connection means for driving the clamp into engagement with the workpiece to secure the workpiece against the clamping surface, said drive means also being capable of moving said clamping surface in accordance with a program stored in said sewing machine in order to sew the predetermined stitch pattern on the workpiece;

said adjustable clamp being adjustable to permit the sewing machine to clamp workpieces of different shapes against the clamping surface so that the predetermined stitch pattern can be sewn on the workpiece when said controller causes said drive means to move the clamping surface in accordance with said program;

said means comprising a 360 degree crank for coupling said adjustable clamp to said sewing machine.

20. A method for sewing a workpiece that is clamped against a sewing surface of a sewing machine, said method comprising the steps of:

(a) positioning an adjustable clamp in operative relationship with said sewing surface; said adjustable clamp having a support and at least one adjustable pressure member adjustably fastened to the support;

(b) adjusting said at least one adjustable pressure member so that said adjustable clamp has a predetermined clamp size which generally corresponds to the shape of the workpiece;

(c) causing said at least one adjustable pressure member to force the workpiece against the sewing surface, thereby clamping the workpiece against the sewing surface in the sewing machine; and (d) sewing a predetermined stitch pattern on the workpiece by sewing around said support and said at least one adjustable pressure member of the adjustable clamp.

21. A sewing machine for sewing a predetermined stitch pattern on a workpiece, said sewing machine comprising:

a controller for controlling the operation of the sewing machine;

an adjustable clamp for forcing a workpiece having a predetermined shape against a clamping surface in the sewing machine; said adjustable clamp being adjustable in order to accommodate workpieces of different shapes;

means for permitting said sewing machine to sew completely around said adjustable clamp so that the sewing machine can sew a 360 degree sewing pattern on said workpiece, said means comprising connection means for mounting said adjustable clamp to said sewing machine, said connection means permitting said sewing machine to sew around said adjustable clamp so that a 360 degree sewing pattern can be sewn on said workpiece; and drive means coupled to said controller and said connection means for driving the clamp into engagement with the workpiece to secure the workpiece against the clamping surface, said drive means also being capable of moving said clamping surface in accordance with a program stored in said sewing machine in order to sew the predetermined stitch pattern on the workpiece;

said adjustable clamp comprising:

a support;

a plurality of clamp members, each of said plurality of clamp members being generally L-shaped and comprising a saw-toothed edge which forces the workpiece into engagement with the clamping surface;

a fastener for adjustably fastening said plurality of clamp members to said support, said fastener comprising at least one post upstanding from said support, each of said plurality of clamp members having at least one groove therein which cooperates with said at least one post to permit each of said clamp member to be slidably adjusted on said support, said fastener also comprising a cooperating member which generally corresponds to the shape of the support, said cooperating member having a plurality of apertures therein for receiving said plurality of post members and for cooperating with said support to secure said at least one clamp member between said cooperating member and said support;

said plurality of clamp members being adjustable to provide a clamp having a predetermined clamp size which generally corresponds to the shape of the workpiece, thereby permitting the sewing machine to clamp workpieces of different shapes against the clamping surface so that the predetermined stitch pattern can be sewn on the workpiece when said controller causes said drive means to move clamping surface in accordance with said program.

22. The sewing machine as recited in claim 21 wherein said mounting means comprises a 360 degree crank for coupling said adjustable clamp to said sewing machine.

* * * * *

UNITED STATES PATENT AND TRADEMARK OFFICE

CERTIFICATE OF CORRECTION

PATENT NO. : 5,146,859

DATED : September 15, 1992

INVENTOR(S) : Ralph F. Conley, Jr. and Clint E. Gehres

It is certified that error appears in the above-identified patent and that said Letters Patent is hereby corrected as shown below:

Column 5, claim 1, line 58, please delete the word "said."

Column 6, claim 5, line 19, please delete "clamp members had" and substitute --clamp members has-- therefor.

Column 6, claim 7, line 30, please delete the word "member."

Column 6, claim 10, line 60, please delete "clamp member" and substitute --of said plurality of clamp members-- therefor.

Column 7, claim 12, line 1, please insert --,-- after the word "therefrom."

Signed and Sealed this

Seventeenth Day of January, 1995

*Attest:*

*Attesting Officer*

BRUCE LEHMAN

*Commissioner of Patents and Trademarks*